US006573881B1

(12) United States Patent
Kwon

(10) Patent No.: US 6,573,881 B1
(45) Date of Patent: Jun. 3, 2003

(54) METHOD FOR DRIVING THE TFT-LCD USING MULTI-PHASE CHARGE SHARING

(76) Inventor: Oh-kyong Kwon, 14-1102 Jangmi Apt., Shinchun-dong, Songpa-gu, Seoul, 138-240 (KR)

( * ) Notice: Subject to any disclaimer, the term of this patent is extended or adjusted under 35 U.S.C. 154(b) by 263 days.

(21) Appl. No.: 09/585,758

(22) Filed: Jun. 2, 2000

(30) Foreign Application Priority Data

Jun. 3, 1999 (KR) ..... 99-20469

(51) Int. Cl.[7] ..... G09G 3/36

(52) U.S. Cl. ..... 345/92; 345/96; 345/90; 345/87; 345/100

(58) Field of Search ..... 345/92, 96, 87–111

(56) References Cited

U.S. PATENT DOCUMENTS

| | | | | | |
|---|---|---|---|---|---|
| 5,325,106 | A | * | 6/1994 | Bahraman | 345/56 |
| 5,448,258 | A | * | 9/1995 | Edwards | 345/90 |
| 6,157,358 | A | * | 12/2000 | Nakajima et al. | 345/96 |
| 6,201,522 | B1 | * | 3/2001 | Erhart et al. | 345/96 |
| 6,271,816 | B1 | * | 8/2001 | Jeong et al. | 345/87 |
| 6,320,568 | B1 | * | 11/2001 | Zavracky | 345/101 |

* cited by examiner

*Primary Examiner*—Steven Saras
*Assistant Examiner*—Michael J. Moyer
(74) *Attorney, Agent, or Firm*—Schweiter Cornman Gross & Bondell LLP

(57) ABSTRACT

There is provided a method for driving the TFT-LCD using multi-phase charge sharing, in which odd-numbered source lines and even-numbered source lines are connected to an external capacitor through a switching element during a period of multi-phase charge sharing time, to share the charges charged in the source lines. The method includes: a first charge sharing step in which even-numbered capacitors, which have been discharged with a voltage $V_L$ during a period of (N-1)th gradation expressing time, are charged with the voltage of an external capacitor, $V_L$+(⅓)Vswing, according to a second selection signal; a second charge sharing step in which odd-numbered capacitors, which have been charged with a voltage $V_H$ during the period of the (N-1)th gradation expressing time, are charged with a voltage $V_L$+(⅔)Vswing through charge sharing with the even-numbered capacitors charged with $V_L$+(⅓)Vswing by the first charge sharing, according to a third selection signal; and a third charge sharing step in which the odd-numbered capacitors, which should be discharged with $V_L$ during a period of the Nth gradation expressing time, are charged with the voltage of the external capacitor, $V_L$+(⅓)Vswing, according to a first selection signal.

4 Claims, 15 Drawing Sheets

Fig.3C
(Prior Art)

odd-numbered frame

| | DL#1 | DL#2 | DL#3 | DL#4 |
|---|---|---|---|---|
| GL#1 | + | — | + | — |
| GL#2 | + | — | + | — |
| GL#3 | + | — | + | — |
| GL#4 | + | — | + | — |

even-numbered frame

| | DL#1 | DL#2 | DL#3 | DL#4 |
|---|---|---|---|---|
| GL#1 | — | + | — | + |
| GL#2 | — | + | — | + |
| GL#3 | — | + | — | + |
| GL#4 | — | + | — | + |

+ positive video signal

— negative video signal

Fig.3D
(Prior Art)

odd-numbered frame

| | DL#1 | DL#2 | DL#3 | DL#4 |
|---|---|---|---|---|
| GL#1 | + | — | + | — |
| GL#2 | — | + | — | + |
| GL#3 | + | — | + | — |
| GL#4 | — | + | — | + |

even-numbered frame

| | DL#1 | DL#2 | DL#3 | DL#4 |
|---|---|---|---|---|
| GL#1 | — | + | — | + |
| GL#2 | + | — | + | — |
| GL#3 | — | + | — | + |
| GL#4 | + | — | + | — |

+ positive video signal

— negative video signal

METHOD FOR DRIVING THE TFT-LCD USING MULTI-PHASE CHARGE SHARING

BACKGROUND OF THE INVENTION

1. Field of the Invention

The present invention relates to a thin film transistor-liquid crystal display (TFT-LCD) and, more particularly, to a method for driving the TFT-LCD using multi-phase charge sharing, in which source lines of the liquid crystal panel are driven with a low power through charge sharing, to reduce the consumption power of a TFT-LCD driving circuit.

2. Discussion of Related Art

In general, a TFT-LCD is being widely used as a screen for a desk-top computer, TV, computer's monitor because it has the most excellent properties in a variety of LCDs, such as high image quality similar to that of CRT, high-speed response and soon. A conventional TFT-LCD, as shown in FIG. 1, includes a liquid crystal panel 10 having a plurality of pixels each of which is located at the point where each of a plurality of gate lines GL intersects each of a plurality of source lines SL, a source driver 20 for supplying a video signal to each of the pixels through a corresponding source line SL of the liquid crystal panel 10, and a gate driver 30 for selecting a gate line GL of the liquid crystal panel 10 to turn on plural pixels. Each pixel consists of a thin film transistor 1 whose gate is connected to a corresponding gate line GL and whose drain is connected to a corresponding source line SL, and a storage capacitor Cs and a liquid crystal capacitor Clc which are connected to the source of the thin film transistor 1 in parallel.

The operation of the conventional TFT-LCD constructed as above is described below with reference to the attached drawings. A sampling register (not shown) of the source driver 20 sequentially receives video data items each of which corresponds to one pixel and stores them which correspond to the source lines SL, respectively. The video data items which are stored in the sampling register are transferred to the holding register by the signal of the controller. The gate driver 30 outputs a gate line selection signal GLS, to select a gate line GL among the plural gate lines GL. Accordingly, the plural thin film transistors connected to the selected gate line GL are turned on to allow the video data stored in the holding register of the source driver 20 to be applied to their drains, thereby displaying the video data on the liquid crystal panel 10.

Here, the source driver 20 supplies VCOM, a positive video signal and a negative video signal to the liquid crystal panel 10, to thereby display the video data thereon. That is, in the operation of the convention TFT-LCD, as shown in FIG. 2, the positive video signal and the negative video signal are alternately supplied to the pixels whenever a frame changes in order not to directly apply DC voltage to the liquid crystal. For this, the intermediate voltage between the positive and negative video signals, VCOM, is applied to an electrode formed on an upper plate of the TFT-LCD. When the positive and negative video signals are alternately provided to the liquid crystal on the basis of VCOM, however, light transmission curves of the liquid crystal do not accord with each other, resulting in flicker.

To reduce the generation of flicker, there is employed one of a frame inversion, line inversion, column inversion and dot inversion, shown in FIGS. 3A to 3D, respectively. The frame inversion of FIG. 3A is a mode that the polarity of the video signal is changed only when the frame is changed. The line inversion of FIG. 3B is a mode that the video signal's polarity is varied whenever the gate line GL changes. The column inversion shown in FIG. 3C converts the polarity of the video signal whenever the source line SL changes, and the dot inversion of FIG. 3D converts it whenever the source line SL, gate line GL and frame change. The image quality is satisfactory in the order of the frame inversion, line inversion, column inversion and dot inversion. A higher image quality requires higher power consumption because the number of the generation of polarity conversions increases in proportional to the image quality. This is explained below with reference to the dot inversion shown in FIG. 4.

FIG. 4 illustrates the waveforms of an odd-numbered source line SL and an even-number source line SL, applied to the liquid crystal panel 10, showing that the video signals of the source lines SL change their polarities on the basis of VCOM whenever the gate line GL changes. Here, when it is assumed that the entire TFT-LCD panel displays gray color, the video signal swing width V of the source lines SL is twice the sum of VCOM and the swing width of the positive video signal or the sum of VCOM and the swing width of the negative video signal. The consumed power at the output terminal of the TFT-LCD when the capacitance of the source line SL is CL is calculated by the following formula.

$$E=C_L \sim V^2$$

That is, the dot inversion consumes a large amount of power because the video signal changes its polarity from (+) to (−) or from (−) to (+) on the basis of VCOM whenever the gate line GL changes.

Furthermore, the conventional TFT-LCD consumes a larger quantity of power to increase the generation of heat in case where its TFT is configured of a polysilicon TFT. Accordingly, the characteristic of the liquid crystal and the property of the TFT are deteriorated due to the heat generated. To solve this problem, there is proposed a method for driving the TFT-LCD in which, in order to supply a desired amount of voltage to the liquid crystal of each pixel, with the voltage of the common electrode being fixed, the source driver supplies both ends of the liquid crystal with a voltage higher than the common electrode voltage in the nth frame, and supplies them with a voltage lower than the common electrode voltage in the (n+1)th frame, the voltages, respectively applied to the pixels placed above the same column line and the pixels placed therebelow, having their polarities different from each other, and the voltages, respectively applied to the pixels placed at the left side of the same row line and the pixels located at the right side thereof, having their polarities different from each other even in the same nth frame.

This TFT-LCD is driven in such a manner that charge sharing is performed with charge sharing time set for every row line for charge sharing, and then a voltage corresponding to video data is applied to each pixel. Since the voltage polarity of odd-numbered pixels of the (M−1)th low line is different from that of even-numbered pixels thereof, odd-numbered source lines are connected to even-numbered source lines through a switching element before a desired amount of voltage corresponding to the video data is applied to the pixels of the Mth row line. By doing so, the source line to which the voltage higher than the common electrode voltage is applied to and the source line to which the voltage lower than the common electrode voltage is applied maintain the maximum voltage at the common electrode through charge sharing. With this charge sharing, the source driving circuit reduces the voltage swing width by half in comparison with that of the conventional circuit, decreasing the power consumed for driving the TFT-LCD. The conventional TFT-LCD using charge sharing, however, connects the odd-numbered source lines SL to the even-numbered source lines SL using a transfer gate for a period of blanking time, to move a part of the charges of the source lines charged with the positive video signal to the source lines charged with the negative video signal to allow them to share the charges. Accordingly, the consumption power is reduced by 50% at most. Furthermore, the conventional TFT-LCD requires a plurality of source drivers in order to realize a higher resolution of VGA class <SVGA class<XGA class<SXGA class<UXGA class. This narrows the line pitch, bring about reliability problems.

SUMMARY OF THE INVENTION

Accordingly, the present invention is directed to a method for driving the TFT-LCD using multi-phase charge sharing that substantially obviates one or more of the problems due to limitations and disadvantages of the related art.

An object of the present invention is to provide a method for driving the TFT-LCD using multi-phase charge sharing, which solves reliability problem between the source lines thereof due to addition of source drivers for realizing a high resolution, and reduces power consumption.

The present invention provides the method for driving the TFT-LCD using multi-phase charge sharing, whose consumption power is reduced much more than that of the conventional TFT-LCD using charge sharing.

To accomplish the object of the present invention, there is provided a TFT-LCD using multi-phase charge sharing, comprising: a source driver for outputting video data signals each of which corresponds to one pixel through a plurality of source lines; switching elements for multi-phase charge sharing; and an external capacitor, connected between a liquid crystal panel and the source driver, for collecting charges of a source line having a voltage higher than a common electrode voltage and supplying them to a source line having a voltage lower than the common electrode voltage when the source lines are connected thereto.

To accomplish the object of the present invention, there is also provided a method for driving a TFT-LCD using multi-phase charge sharing, in which at least one selection signal is applied to drive the TFT-LCD for a period of multi-phase charge sharing time, the method comprising: a first charge sharing step in which even-numbered capacitors, which have been discharged with a voltage $V_L$ during a period of (N−1)th gradation expressing time, are charged with the voltage of an external capacitor, $V_L+(1/3)$Vswing, according to a second selection signal; a second charge sharing step in which odd-numbered capacitors, which have been charged with a voltage $V_H$ during the period of the (N−1)th gradation expressing time, are charged with a voltage $V_L+(2/3)$Vswing through charge sharing with the even-numbered capacitors charged with $V_L+(1/3)$Vswing by the first charge sharing, according to a third selection signal; and a third charge sharing step in which the odd-numbered capacitors, which should be discharged with $V_L$ during a period of the Nth gradation expressing time, are charged with the voltage of the external capacitor, $V_L+(1/3)$Vswing, according to a first selection signal.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 3A to 3D show TFT-LCD inversion modes;

DETAILED DESCRIPTION OF PREFERRED EMBODIMENT

Reference will now be made in detail to the preferred embodiments of the present invention, examples of which are illustrated in the accompanying drawings.

Figure 1:
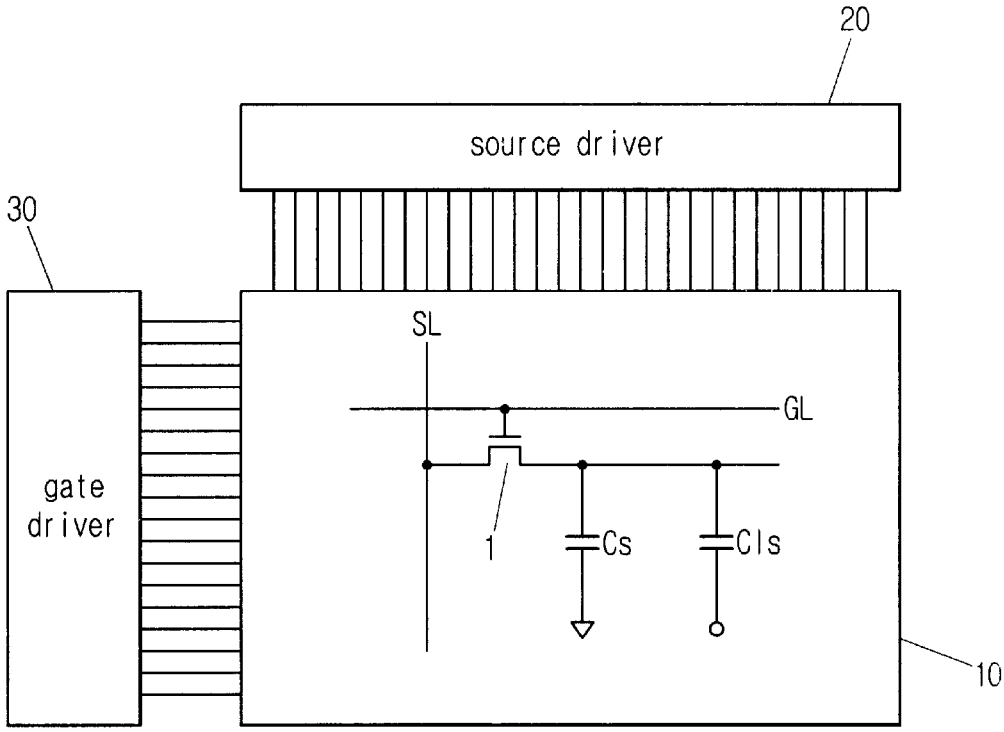
Fig.1 (Prior Art)
FIG. 1 is a block diagram of a conventional TFT-LCD.
Figure 2:
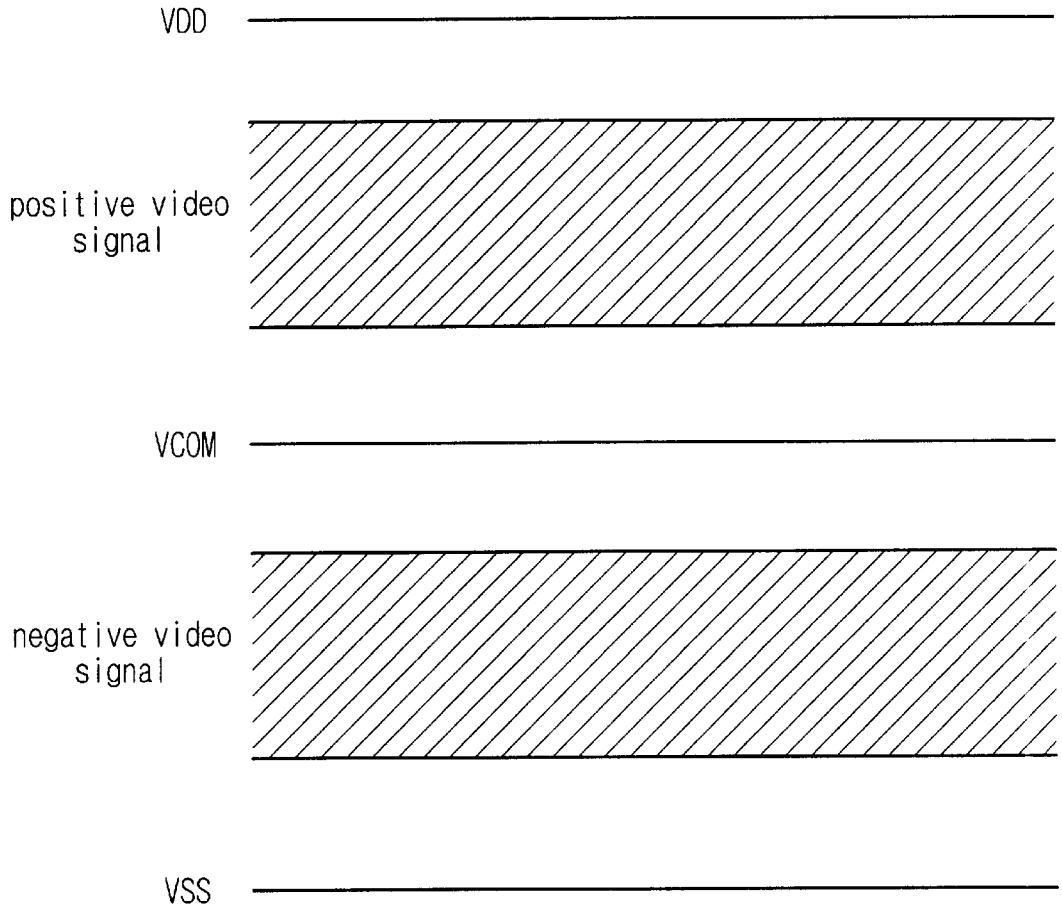
Fig.2 (Prior Art)
FIG. 2 shows the operation waveforms of FIG. 1.
Figure 3A:
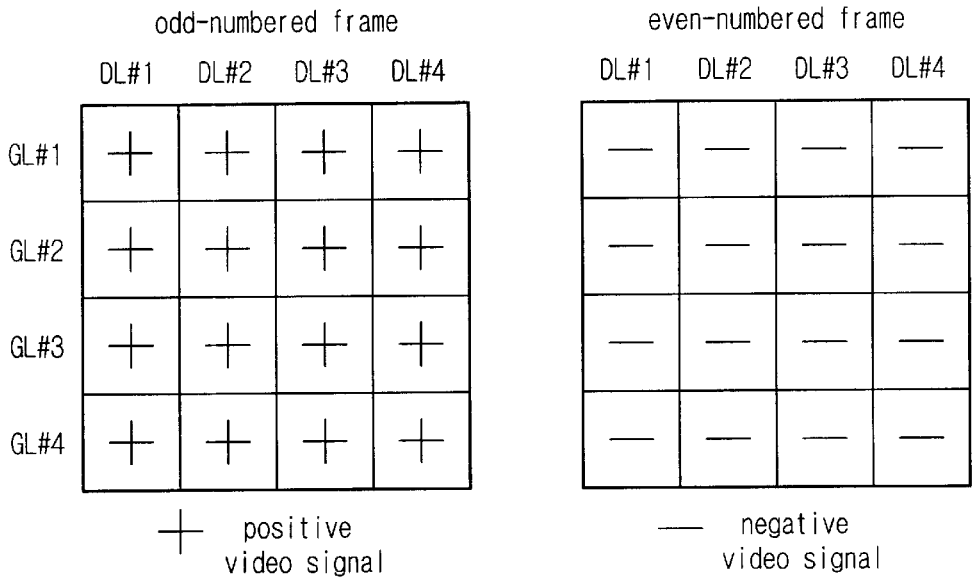
Fig.3A (Prior Art)
Figure 3B:
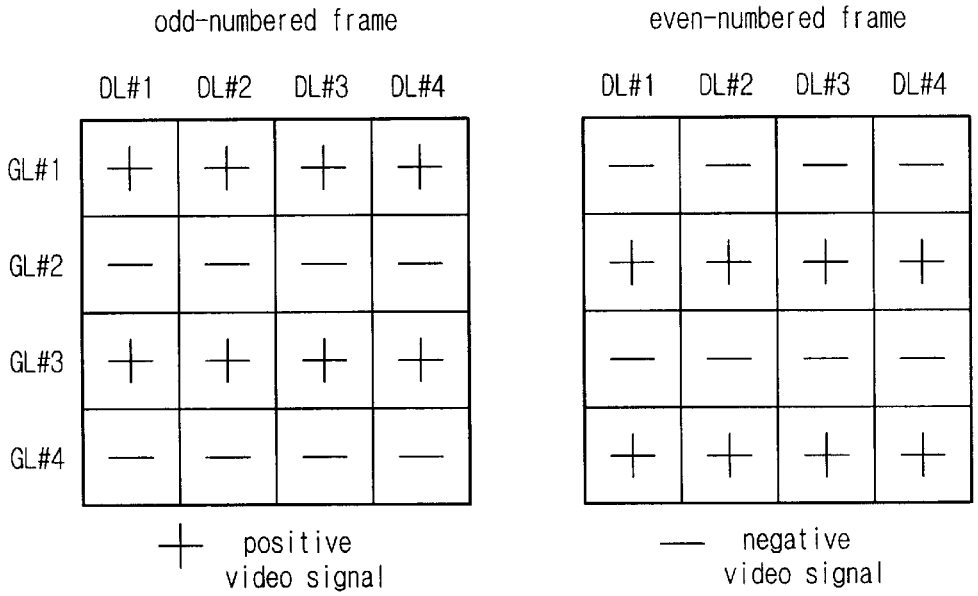
Fig.3B (Prior Art)
Figure 4:
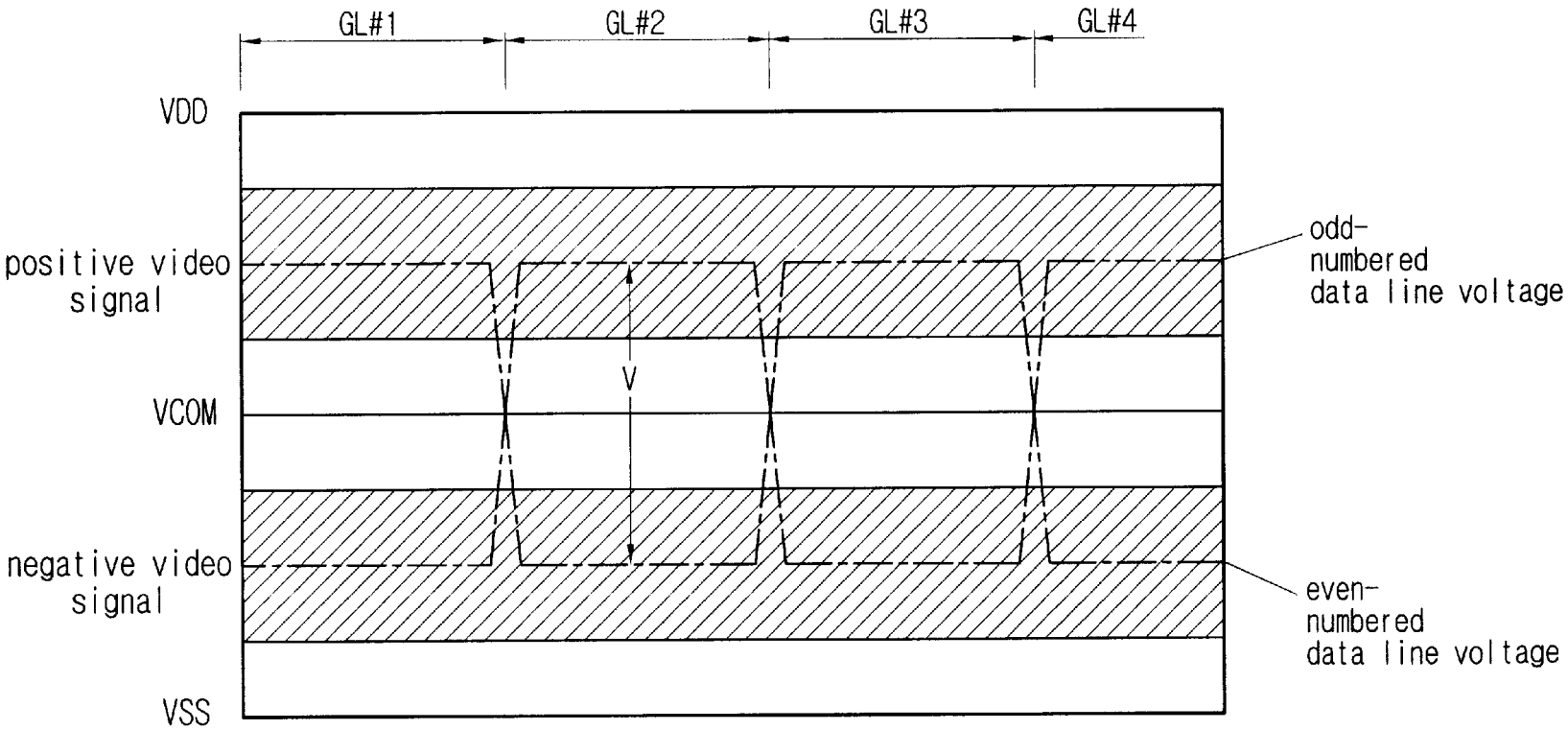
Fig.4 (Prior Art)
FIG. 4 shows the output waveforms in dot inversion mode.
Figure 5:
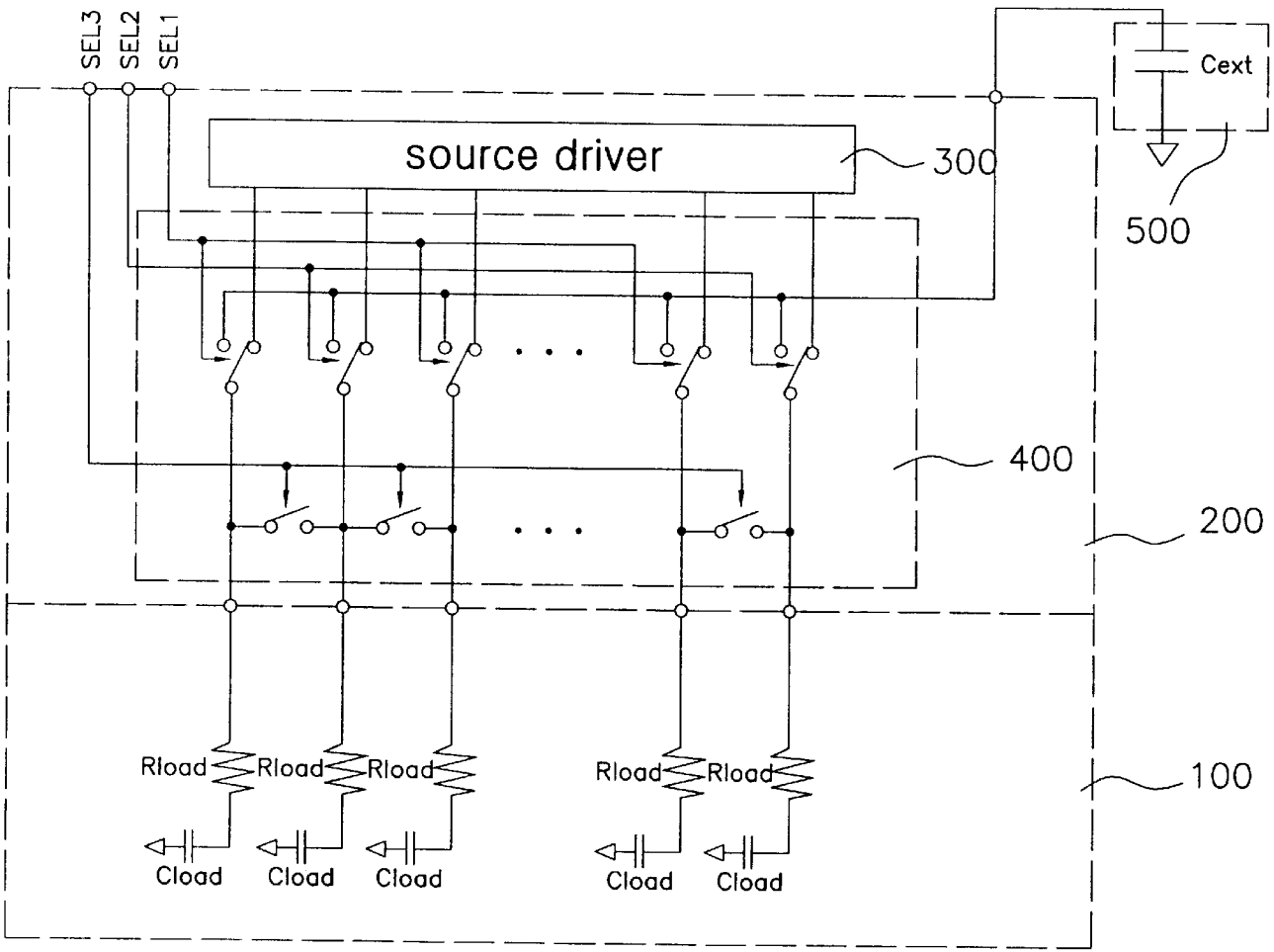
FIG. 5 is a block diagram of a TFT-LCD driving circuit according to the present invention.

There will be described below a TFT-LCD using multi-phase charge sharing according to a preferred embodiment of the present invention with reference to the attached drawings. Referring to FIG. 5, the TFT-LCD using multi-phase charge sharing according to the present invention includes a line driver 200 which outputs video data signals each of which corresponds to each pixel through a plurality of source lines, a liquid crystal panel 100 for displaying the video signals applied through the source lines, and an external capacitor 500, connected between the line driver 200 and the liquid crystal panel 100, for collecting charges of source lines having a voltage higher than a common electrode voltage and supplying them to source lines having a voltage lower than the common electrode voltage when the source lines are connected thereto.

The line driver 200 includes a source driver 300 for supplying the pixels with video signals through the source lines of the liquid crystal panel 100, and a switching section 400 for connecting the source lines of the liquid crystal panel 100 to the source driver 300 or the external capacitor 500 according to an external driving signal. In the driving circuit of the TFT-LCD using multi-phase charge sharing, constructed as above, odd-numbered source lines are connected to output terminals of the source driver 300 or the external capacitor 500 according to a first selection signal SEL1. Similarly, even-numbered source lines are connected to output terminals of the source driver 300 or the external capacitor 500 according to a second selection signal SEL2.

Upon application of a third selection signal SEL3, all of the source lines of the TFT-LCD are connected to one another. Here, each source line has a capacitive load and a resistive load. In FIG. 5, a capacitance $C_{load}$ represents the source line's capacitor operating as the capacitive load, and a resistance $R_{load}$ represents the resistive load of the source line. The external capacitor $C_{ext}$ has capacitance much larger than the capacitance $C_{load}$, and it serves as an auxiliary power supply charging the capacitance $C_{load}$.

Figure 6:
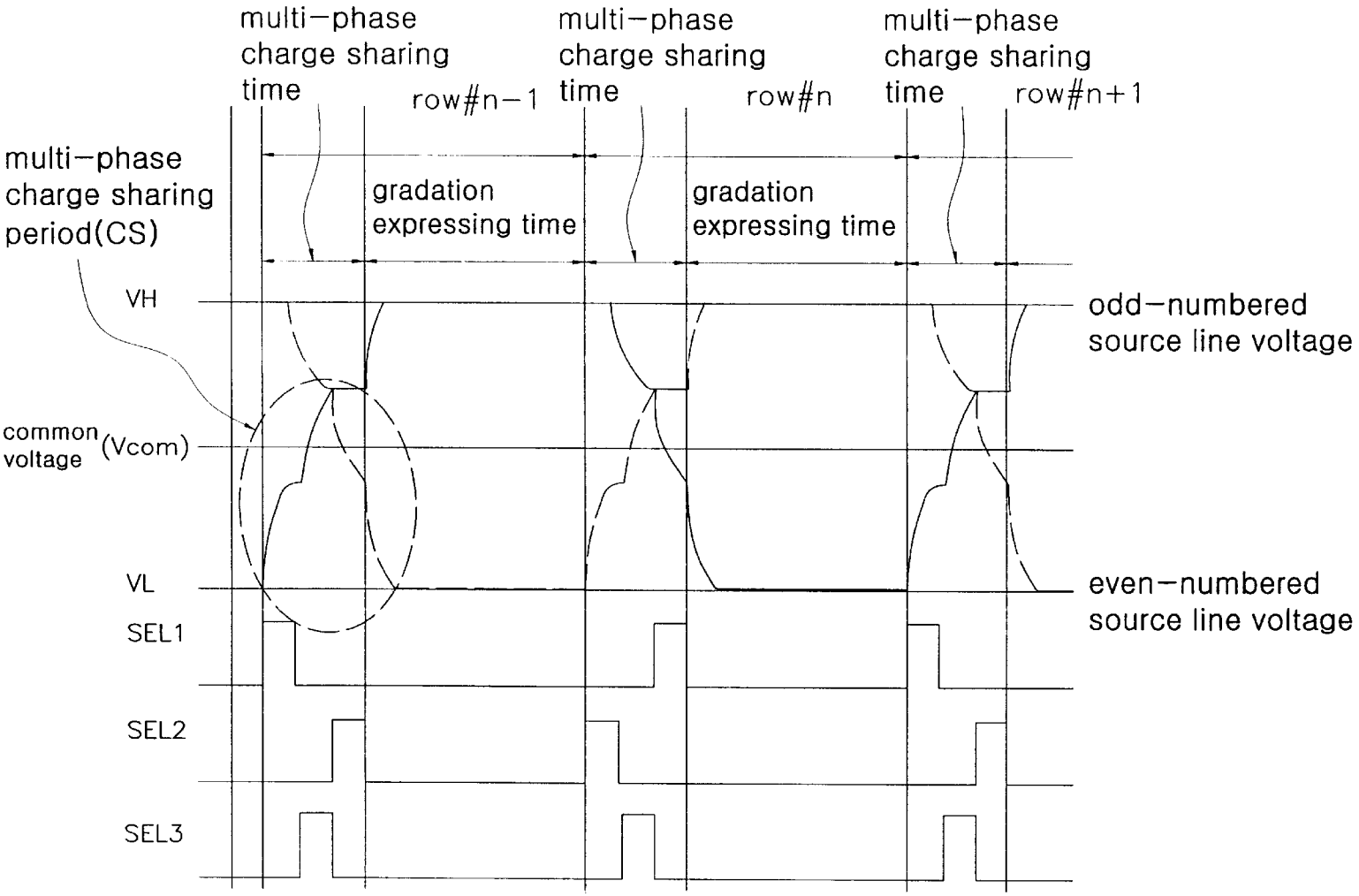
FIG. 6 shows the input/output waveforms of signals of sections constructing the driving circuit of FIG. 5.

FIG. 6 shows the input/output waveforms of signals of sections constructing the driving circuit of the TFT-LCD according to the present invention, illustrating the selection signals applied to the line switching section 400 and a voltage whose charges are shared according to these selection signals. Let it be assumed that the number of the capacitive loads $C_{load}$ is M, the number of the capacitive loads charged with a voltage $V_H$ is M/2, and the number of the capacitive loads $C_{load}$ discharged with a voltage $V_L$ is M/2. Here, $V_H$ corresponds to a source line voltage having the positive polarity for expressing a multilevel image, and $V_L$ corresponds to an odd-numbered source line voltage having the negative polarity for expressing the same multilevel image.

In addition, let it be assumed that the odd-numbered capacitive loads $C_{load}$ have been charged with $V_H$ and the even-numbered capacitive loads $C_{load}$ have been discharged with $V_L$ after a lapse of the driving time of the (N−1)th capacitive loads $C_{load}$. Also, it is assumed that the odd-numbered capacitive loads $C_{load}$ are discharged with $V_L$ and the even-numbered capacitive loads $C_{load}$ are charged with $V_H$ during a period of the driving time of the Nth capacitive load. Furthermore, let it be assumed that the external capacitor $C_{ext}$ is considerably larger than the capacitive load $C_{load}$ and charged with a predetermined-level voltage to operate as a voltage source substantially. Here, the external capacitor $C_{ext}$ is charged with the voltage of $V_L$+(⅓)Vswing, as explained below, to serve as the voltage source even when the voltage is not externally applied thereto. The Vswing represents the difference between $V_H$ and $V_L$. In other words, the Vswing means the voltage swing width supplied by the conventional source driver in order to charge the capacitive load $C_{load}$ having $V_L$ with $V_H$ . Moreover, let it be assumed that the output terminals of the source driver 300 are in a high impedance state during multi-phase charge sharing period. There will be explained below a method for driving the TFT-LCD using multi-phase charge sharing according to the present invention under the aforementioned conditions.

Referring to FIGS. 5 and 6, at the first charge sharing stage, upon application of the second selection signal SEL2 during a period of the Nth capacitive load driving time, i.e., the period of row line driving time, line switches of the line switching section 400, to which the second selection signal SEL2 is applied, are turned on. Accordingly, the even-numbered capacitive loads $C_{load}$ which have been discharged with $V_L$ during a period of the (N−1)th gradation expressing time are connected to the external capacitor $C_{ext}$ to accomplish charge balance through charge sharing, thereby being charged with the voltage $V_L$+(⅓)Vswing of the external capacitor $C_{ext}$.

Next, at the second charge sharing stage, the line switches to which the second selection signal SEL2 is applied are turned off and line switches with which the third selection signal SEL3 is provided are turned on. Accordingly, the odd-numbered capacitive loads $C_{load}$ which have been charged with $V_H$ during the period of the (N−1)th gradation expressing time are connected to the even-numbered capacitive loads $C_{load}$ charged with $V_L$+(⅓)Vswing at the first charge sharing stage, to allow all of the capacitive loads to have a voltage $V_L$+(⅔)Vswing higher than the $V_L$+(½) Vswing.

Subsequently, at the third charge sharing stage, the line switches to which the third selection signal SEL3 is applied are turned off and line switches with which the first selection signal SEL1 is provided are turned on. Accordingly, the odd-numbered capacitive loads $C_{load}$ which should be discharged with $V_L$ during a period of the Nth gradation expressing time are connected to the external capacitor $C_{ext}$ to share charges. At this time, the capacitive loads $C_{load}$ have the voltage of $V_L$+(⅓)Vswing of the external capacitor $C_{ext}$. After this, the line switches to which the first selection signal SEL1 is applied are turned off, completing the multi-phase charge sharing.

Upon completion of the Nth multi-phase charge sharing, the odd-numbered capacitive loads $C_{load}$ become the voltage of $V_L$+(⅓)Vswing and the even-numbered capacitive loads $C_{load}$ become the voltage of $V_L$+(⅔)Vswing. Subsequently, the output driver of the liquid crystal panel 100 charges the even-numbered capacitive loads $C_{load}$ having the $V_L$+(⅔) Vswing with $V_H$, and discharges the odd-numbered capacitive loads $C_{load}$ with $V_L$ during a period of gradation expressing time. Meantime, during a period of the (N+1)th capacitive load driving time, switching of the line switches coupled to the first and second selection signals SEL1 and SEL2 is performed in the order reverse to that carried out during a period of the Nth capacitive load driving time because the odd-numbered capacitive loads and the even-numbered capacitive loads should be charged and discharged with voltages opposite to those in case of the Nth capacitive load driving time.

Figure 7:
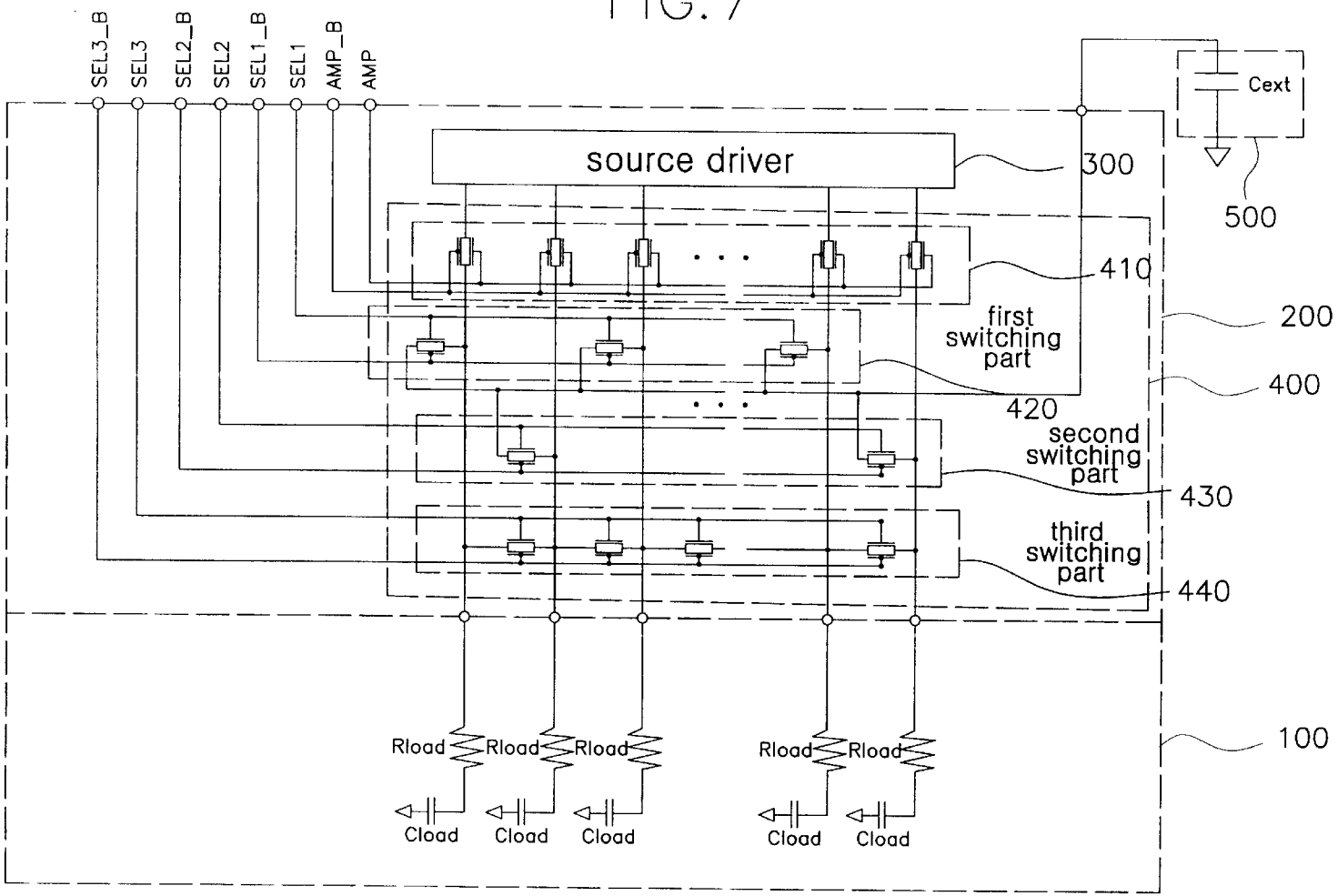
FIG. 7 is a block diagram of a TFT-LCD according to an embodiment of the present invention.
Figure 8:
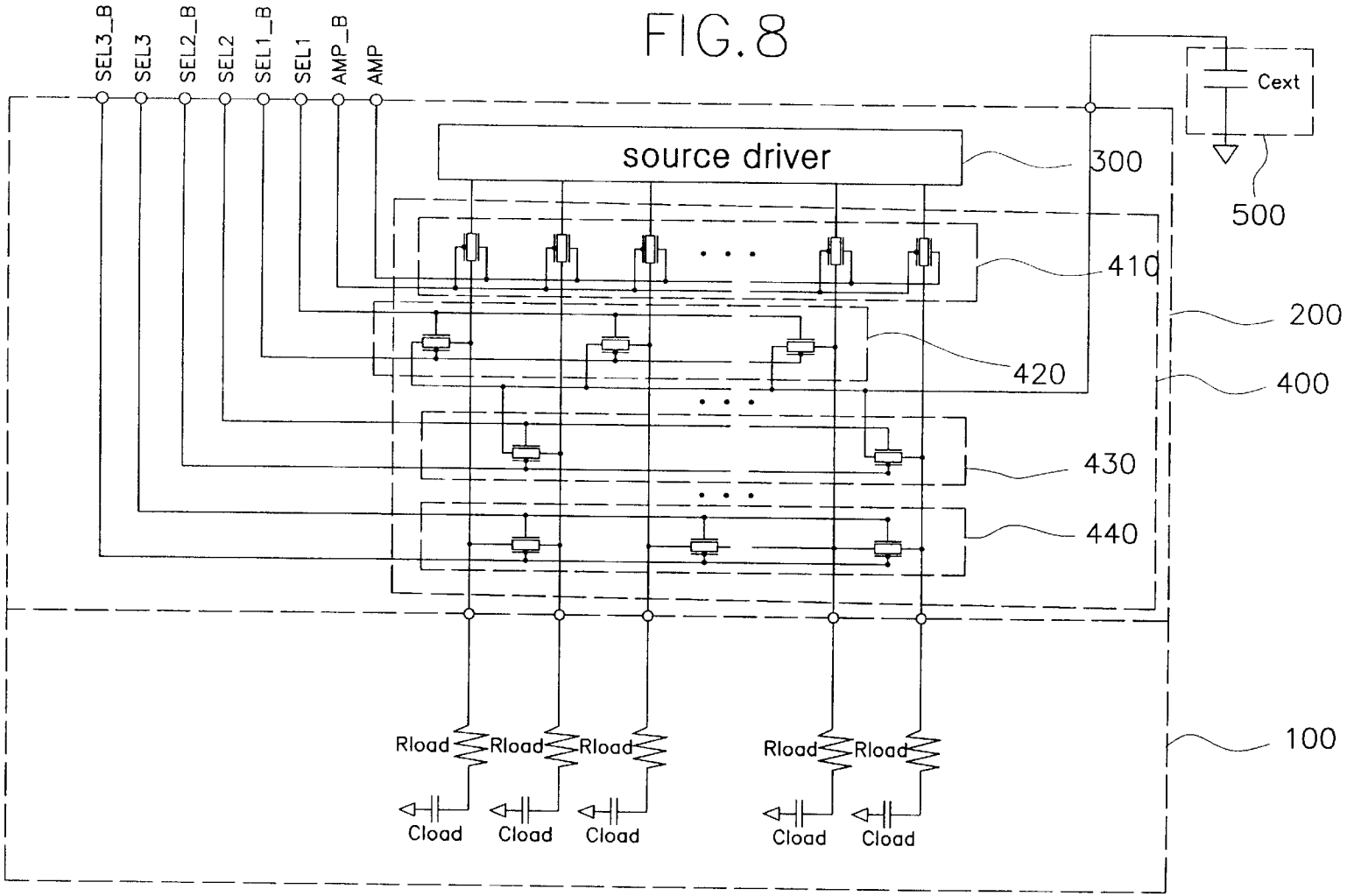
FIG. 8 is a block diagram of a TFT-LCD according to another embodiment of the present invention.

FIG. 7 is a block diagram of a TFT-LCD driving circuit according to an embodiment of the present invention, and FIG. 8 is a block diagram of a TFT-LCD driving circuit according to another embodiment of the present invention. Referring to FIG. 7, the TFT-LCD driving circuit according to the present invention is identical to the TFT-LCD driving circuit of FIG. 5 in the basic configuration and has a difference from that in that the line switching section 400 is configured of transfer gates. The TFT-LCD driving circuit of this embodiment performs multi-phase charge sharing operation as described above. Here, the line switching section 400 may be configured of PMOS transistors or NMOS transistors other than the transfer gates. The detailed configuration of the line switching section will be explained below.

The line switching section 400 includes a transfer gate part 410 for making the output terminals of the source driver 300 be in the high impedance state according to control signals AMP and AMP_B, first and second switching parts 420 and 430 for connecting each source line of the liquid crystal panel 100 to the external capacitor 500 according to the first and second selection signals SEL1 and SEL2, respectively, and a third switching part 440 connected to the source lines adjacent to the liquid crystal panel 100 according to the third selection signal SEL3. Here, the third switching part 440 is configured of transfer gates each of which is connected to each of the source lines adjacent to the liquid crystal panel.

Referring to FIG. 8, each of switches constructing the third switching part 440 is connected to the (2N−1)th and 2Nth source lines. That is, each of the transfer gates constructing the third switching part 440 is connected only between the (2N−1)th and 2Nth source lines, but is not connected between the 2Nth and (2N+1) th source lines. With this configuration, although the pixel voltage is locally varied after the two charge sharing steps in case where different video data signal are applied from the row lines to the LCD depending on the locations of the pixels, there is not a considerable difference in the total LCD consumption power. The consumption power of the TFT-LCD can be obtained using the following formula.

$$P_{av}=V_{DD}\cdot I_{av}$$

$$=V_{DD}\cdot[M\cdot C_L\cdot V_{swing}\cdot(\text{freq}/2)]$$

where M represents the number of the capacitive loads, $V_{DD}$ represents the supply power, Vswing indicates the width of a voltage charging and discharging the capacitive load, $C_L$ indicates the capacitive load, and freq represents a driving frequency when the capacitive loads are charged or discharged. Here, the voltage width Vswing deciding a consumption power index is determined by waveforms shown in FIG. 9. Although the Vswing became (½)Vswing after charge sharing in the conventional driving method according to the aforementioned formula, it was confirmed through HSPICE that the Vswing is reduced to (⅓)Vswing maximum through the multi-phase charge sharing in the present invention.

Figure 9:
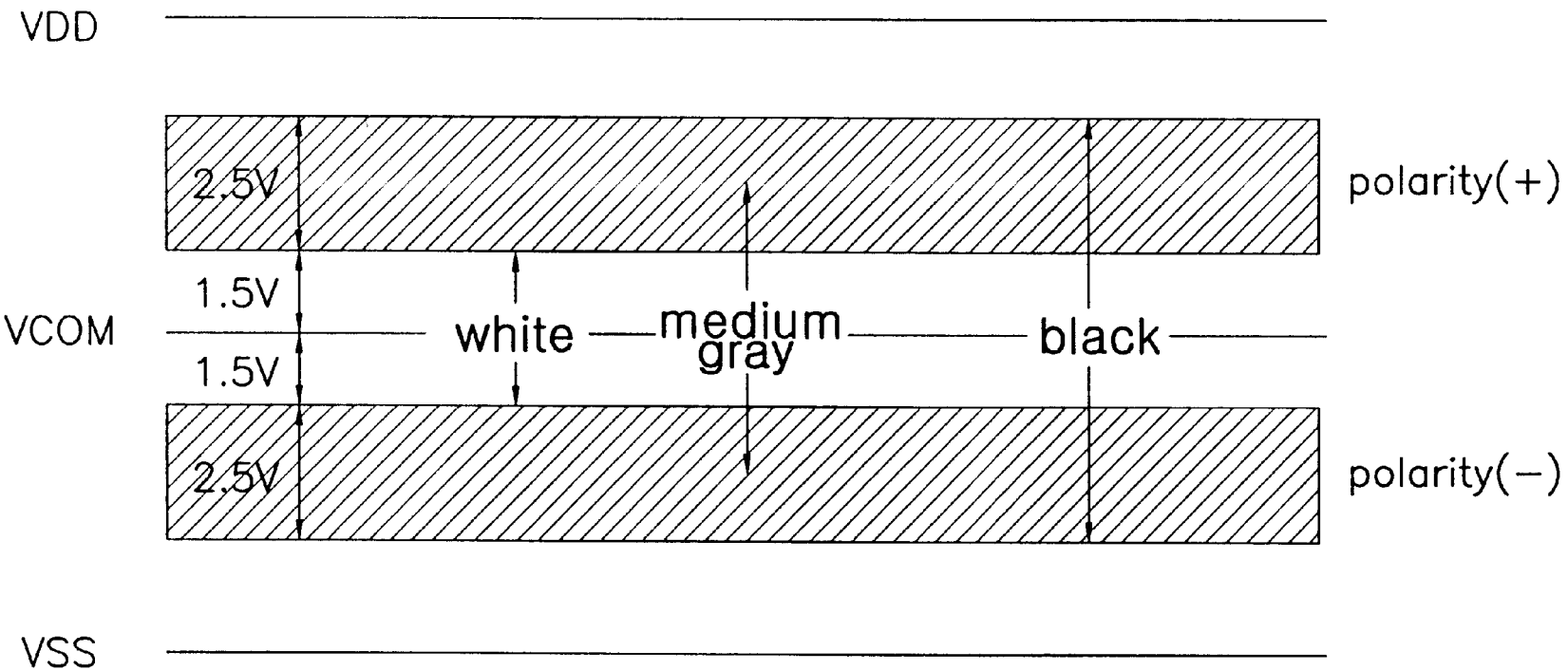
FIG. 9 shows the comparison between a voltage swing width and consumption power according to inputting of a video signal.
Figure 10A:
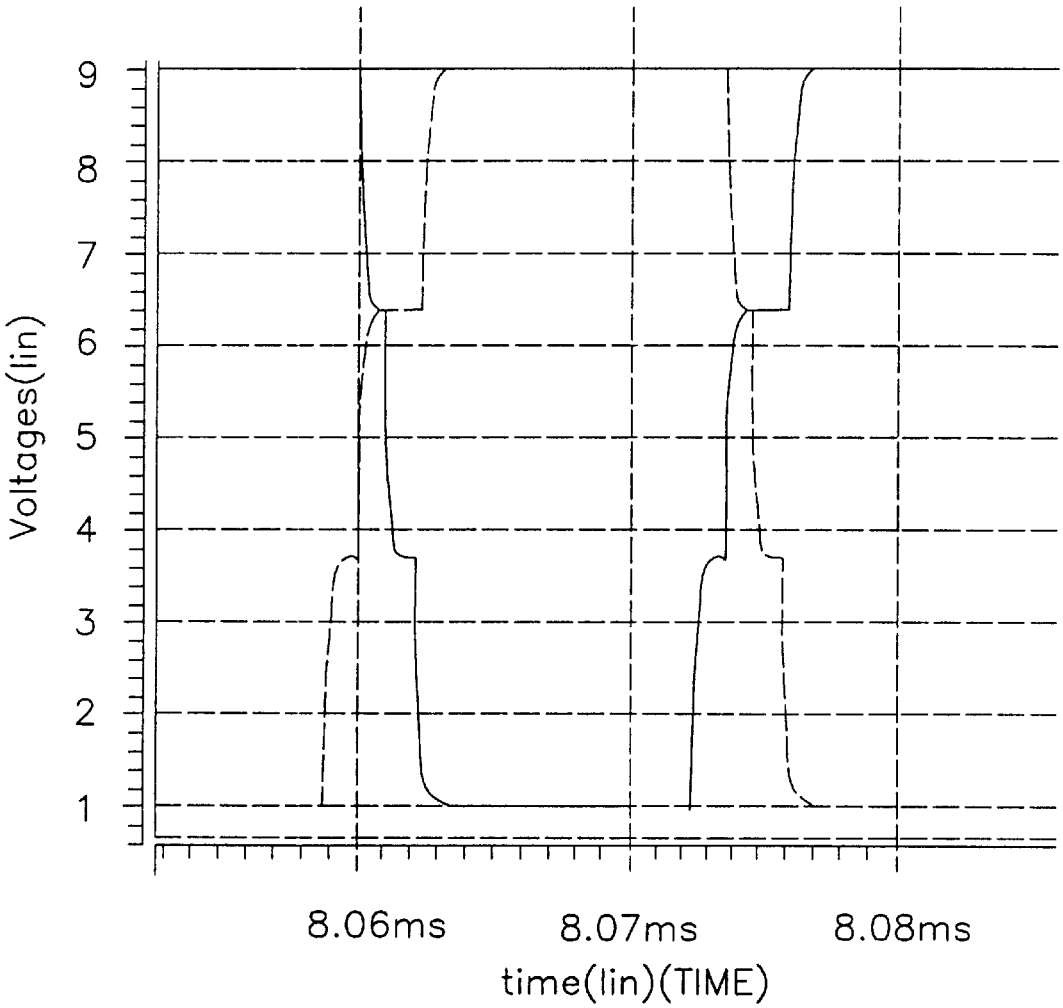
FIG. 10A shows a sharing voltage waveform when a black image is expressed.
Figure 10B:
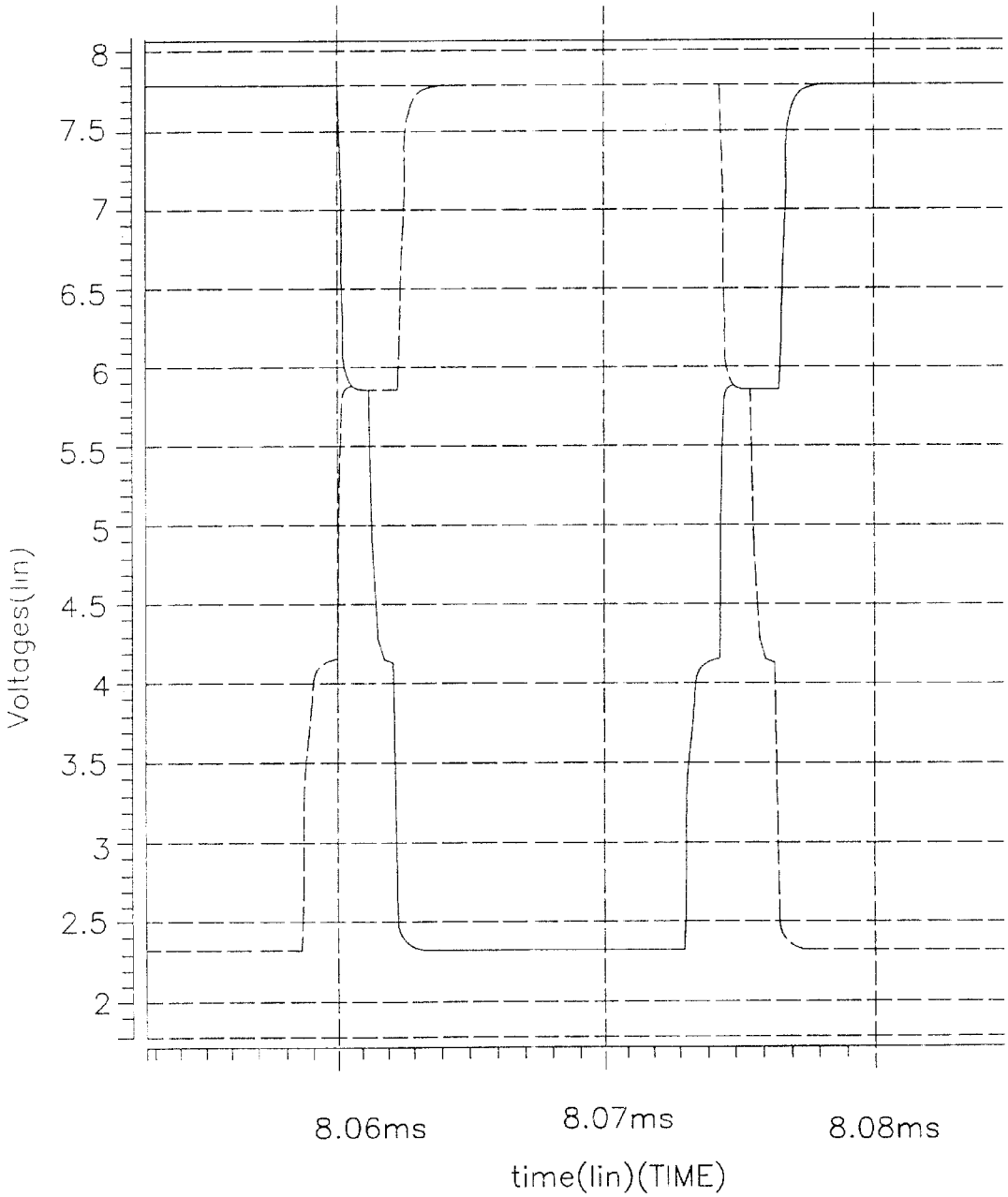
FIG. 10B shows a sharing voltage waveform when a medium gray image is expressed.
Figure 10C:
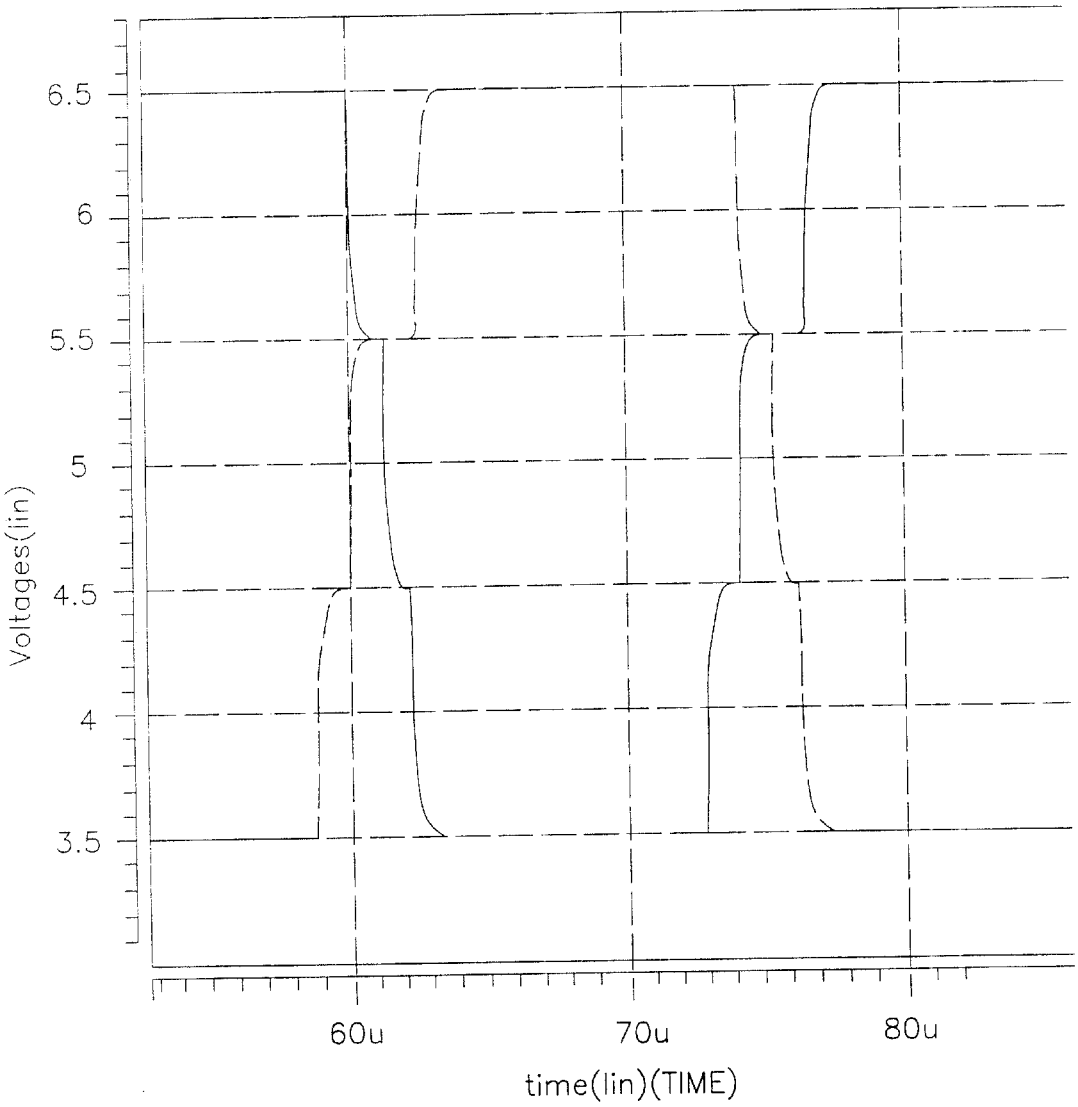
FIG. 10C shows a sharing voltage waveform when a white image is expressed.

Referring to FIG. 9, in the voltage swing width according to inputting of video signals, the voltage swing width for expressing white is the narrowest. This corresponds to "normally white" that light is transmitted through the liquid crystal without application of voltage. FIG. 10C shows the waveforms of sharing voltage when a white image is expressed. Furthermore, the voltage swing width of the medium gray is a little wider than that of white, and the voltage swing width in case of black is the widest. FIGS. 10A and 10B show the waveforms of sharing voltages when the black and medium gray images are expressed, respectively.

Referring to FIGS. 10A, 10B and 10C, the voltage of the capacitive load after the multi-phase charge sharing obtains the same characteristic whether it is initially charged or not. In the FIGS. 10A, 10B and 10C, the voltage width Vswing is reduced to (⅓)Vswing in comparison with the conventional one, reaching a consumption power reduction efficiency of 66.6% under a predetermined simulation condition. Here, the consumption power reduction efficiency can be varied with RC time constants of the source lines and the length of charge sharing time of the source lines.

The external capacitor can be initially charged with the voltage $V_L$+(⅓)Vswing or more, and, even if it is not charged, charged with $V_L$+(⅓)Vswing according to the driving method proposed by the present invention, to substantially operate as a voltage source. Accordingly, it can be confirmed through the HSPICE simulation shown in FIGS. 10A, 10B and 10C that the TFT-LCD of the present invention increases more its consumption power reduction efficiency as the magnitude of the resistive load of the source lines decreases or the charge sharing time thereof increases.

Figure 11:
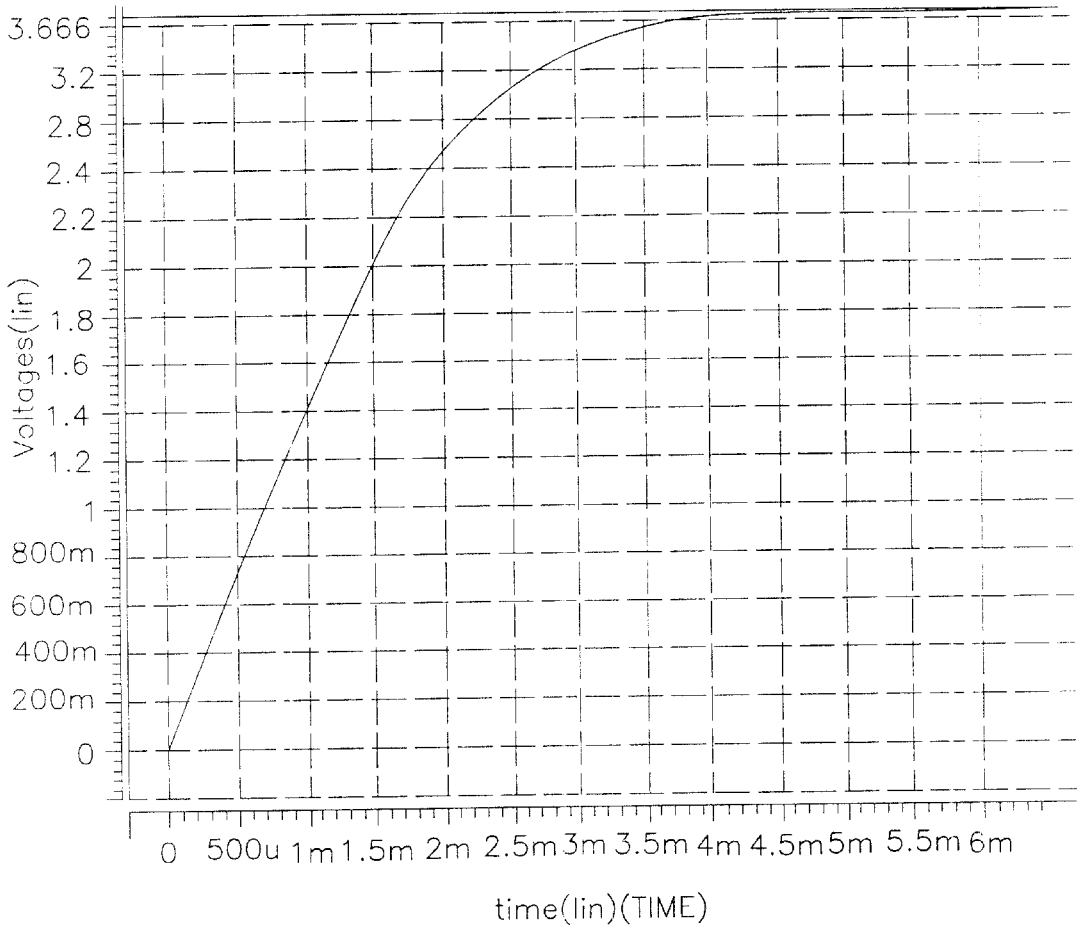
FIG. 11 shows a voltage waveform of an external capacitor when the black image is expressed.

FIG. 11 shows the voltage waveform of the external capacitance $C_{ext}$ when the black image is expressed according to the driving method of the present invention, being confirmed through the HSPICE simulation. Referring to FIG. 11, the external capacitance is charged while the TFT-LCD is driven even if it has not been initially charged, to operate as a voltage source. The voltage of the external capacitance, confirmed through the simulation, becomes 3.666 V after a lapse of predetermined time. At this time, though the voltage of the external capacitance depends on video signals, there is no variation in the average consumption power reduction efficiency.

Figure 12:
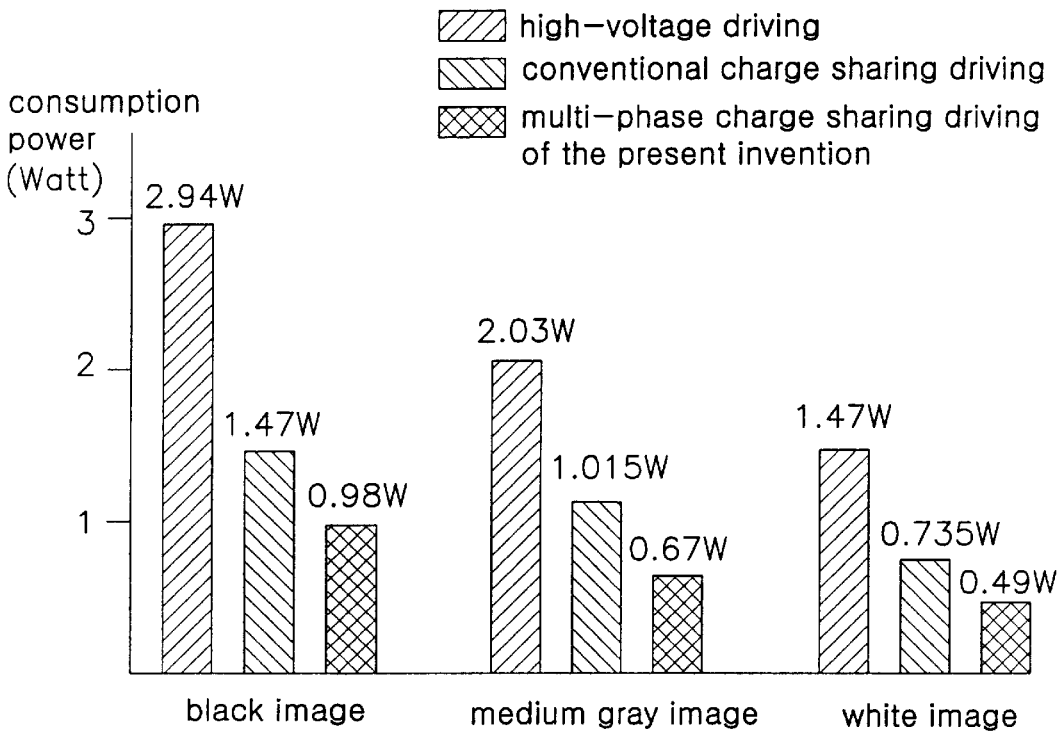
FIG. 12 is a graph showing consumption power reduction efficiency according to the present invention.

Accordingly, the consumption power reduction efficiency which can be obtained by the multi-phase charge sharing of the present invention is proportional to the magnitude of the switches, the magnitude of the external capacitor and charge sharing time, and results in 66.6% even under the influence of RC time constants of the loads. FIG. 12 is a graph showing the consumption power when an SXGA class TFT-LCD is driven according to the present invention. From this graph, it is observed that the driving consumption power of the present invention is reduced to one-third of the conventional one without regard to video images.

As described above, the circuit driving a TFT-LCD using multi-phase charge sharing according to the present invention has the following advantages. First of all, the TFT-LCD driving circuit shares the charges of the source lines during the period of multi-phase charge sharing time, to thereby reduce the driving power consumption of the liquid crystal panel to one-third of the conventional one. Secondly, the TFT-LCD driving circuit of the present invention generates less heat due to reduction in its consumption power. Thus, deterioration in characteristics of the liquid crystal and TFT caused by heat is decreased in case where the TFT-LCD is configured of a polysilicon TFT.

Thirdly, the high-resolution TFT-LCD according to the present invention uses at least one line switching element to solve reliability problem between the source lines due to addition of source drivers, realizing a low-power liquid crystal display. Moreover, in the TFT-LCD using multi-phase charge sharing according to the present invention, the switching section of the source driver can be configured of a variety of switching elements.

It will be apparent to those skilled in the art that various modifications and variations can be made in the TFT-LCD using multi-phase charge sharing of the present invention without departing from the spirit or scope of the invention. Thus, it is intended that the present invention covers the modifications and the variations of this invention provided they come within the scope of the appended claims and their equivalents.

What is claimed is:

1. A method for driving a TFT-LCD using multi-phase charge sharing in a column inversion mode or in a dot inversion mode, in which at least one selection signal is applied to drive the TFT-LCD during a period having a polarity modulation time interval and gradation expressing time interval, wherein the TFT-LCD includes a plurality of source lines, a source driver for outputting video data signals, each of which corresponds to one pixel through the plurality of source lines, a liquid crystal panel for expressing the video signals supplied through the source lines, and an external capacitor, the method comprising:

i) at an Nth polarity modulation time interval, a first charge sharing step in which all the even-numbered source line capacitors are charged with a voltage $V_L$+(⅓)$V_{swing}$ of the external capacitor by connecting all the even-numbered source line capacitors, which have been discharged with a voltage $V_L$ during a prior period of an (N−1)th gradation expressing time interval, to the external capacitor according to a second selection signal;

a second charge sharing step in which all the source lines capacitors are brought to a voltage $V_L+(2/3)V_{swing}$ through connecting all the odd-numbered source line capacitors, which have been charged with a voltage $V_H$ during the prior period of the (N−1)th gradation expressing time interval, to all the even-numbered source line capacitors, which have been charged with $V_L+(1/3)V_{swing}$ in the first charge sharing step, according to a third selection signal; and a third charge sharing step in which all the odd-numbered source line capacitors are discharged with the voltage $V_L+(1/3)V_{swing}$ of the external capacitor by connecting all the odd-numbered source line capacitors, which have been discharged with the voltage $V_L+(2/3)V_{swing}$ in the second charge sharing step, to the external capacitor according to a first selection signal; and ii) at an Nth gradation expressing time interval, charging each of the even-numbered source line capacitors which has been charged with the voltage $V_L+(2/3)V_{swing}$ in the second charge sharing step with a voltage to express a gray scale image of positive polarity, and discharging each of the odd-numbered source line capacitors which has been discharged with the voltage $V_L+(1/3)V_{swing}$ in the third charge sharing step with a voltage to express a gray scale image of negative polarity, wherein, $V_H$ represents a mean of source line voltages to express a predetermined gray scale image in a voltage region for expressing a gray scale image of positive polarity, $V_L$ represents a mean of source line voltages to express a predetermined gray scale image in a voltage region for expressing a gray scale image of negative polarity, and $V_{swing}$ represents the difference between $V_H$ and $V_L$.

2. The method for driving a TFT-LCD using multi-phase charge sharing as claimed in claim 1, wherein, in the first charge sharing step, a second switching section is turned on according to the second selection signal during the Nth polarity modulation time interval so that all the even-numbered source line capacitors are connected to the external capacitor.

3. The method for driving a TFT-LCD using multi-phase charge sharing as claimed in claim 1, wherein, in the second charge sharing step, a third switching section is turned on according to the third selection signal during the Nth polarity modulation time interval so that all the odd-numbered source line capacitors are connected to all the even-numbered source line capacitors, thereby allowing all of the source line capacitors to have a voltage $V_L+(2/3)V_{swing}$ which is higher than $V_L+(1/2)V_{swing}$.

4. The method for driving a TFT-LCD using multi-phase charge sharing as claimed in claim 1 wherein, in the third charge sharing step, a first switching section is turned on according to the first selection signal during the Nth polarity modulation time interval so that the all the even-numbered source line capacitors are connected to the external capacitor.

* * * * *